United States Patent [19]

Timmons

[11] 4,335,647

[45] Jun. 22, 1982

[54] AIR DEVICE WITH FLEXIBLE MOUNTING SYSTEM

[75] Inventor: David R. Timmons, Newport Beach, Calif.

[73] Assignee: Automation Industries, Inc., Greenwich, Conn.

[21] Appl. No.: 248,425

[22] Filed: Mar. 27, 1981

Related U.S. Application Data

[62] Division of Ser. No. 95,841, Nov. 19, 1979, Pat. No. 4,271,751, which is a division of Ser. No. 892,168, Mar. 31, 1978, abandoned.

[51] Int. Cl.[3] ..... F24F 7/00

[52] U.S. Cl. ..... 98/40 D; 248/224.4; 52/219; 138/106; 98/40 A; 98/40 N; 98/40 C

[58] Field of Search ..... 98/40 D, 40 R, 40 C, 98/41 R, 40 B, 40 V, 40 N, 40 A; 138/106, 107; 248/224.1, 224.2, 223.4, 56, 73; 52/219

[56] References Cited

U.S. PATENT DOCUMENTS

| | | | |
|---|---|---|---|
| 1,247,938 | 11/1917 | Curtenids | 248/224.4 |
| 2,996,138 | 8/1961 | Schwartz et al. | 98/40 D |
| 3,765,316 | 10/1973 | Skoch | 98/40 D |
| 3,809,350 | 5/1974 | Lane | 52/219 |
| 3,985,158 | 10/1976 | Felter | 52/219 |
| 4,109,564 | 8/1978 | Widerby | 98/40 B |

*Primary Examiner*—Henry C. Yuen
*Attorney, Agent, or Firm*—Francis N. Carten

[57] ABSTRACT

The ventilation air terminal device for supplying heated, air conditioned or ventilating air to an enclosure comprises cylindrically tubular transition with a mounting bracket thereon for mounting the terminal device with respect to the wall, ceiling or floor. The terminal device extends through an opening in the wall, ceiling or floor, and the mounting bracket secures it flush with the inside of the wall, ceiling or floor. A dome-shaped, circular air diffuser secures over the front of the terminal device to direct air discharging therefrom.

4 Claims, 28 Drawing Figures

Fig. 5
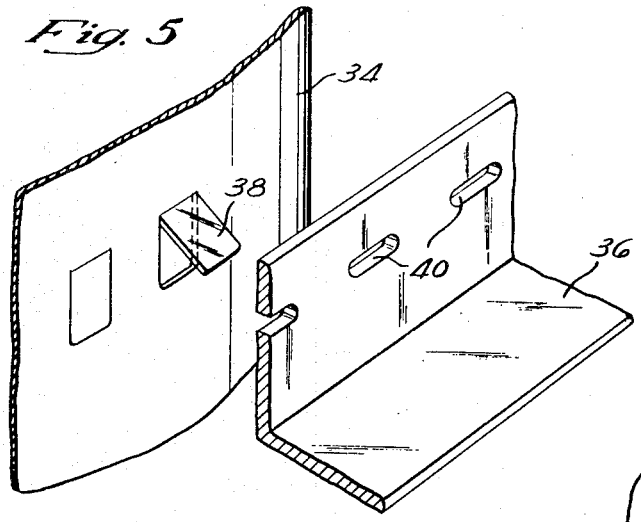
Fig. 6
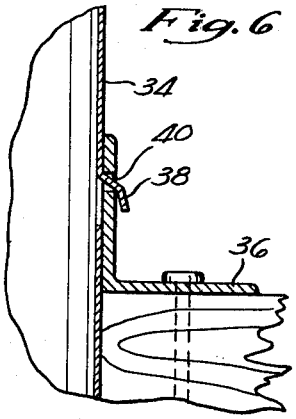
Fig. 7
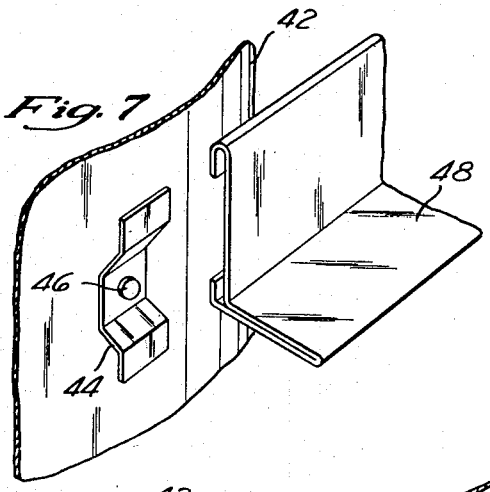
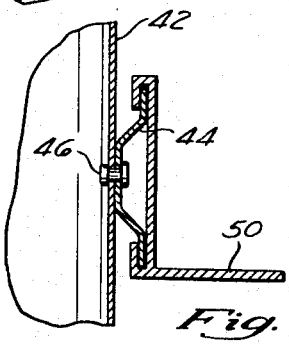
Fig. 9
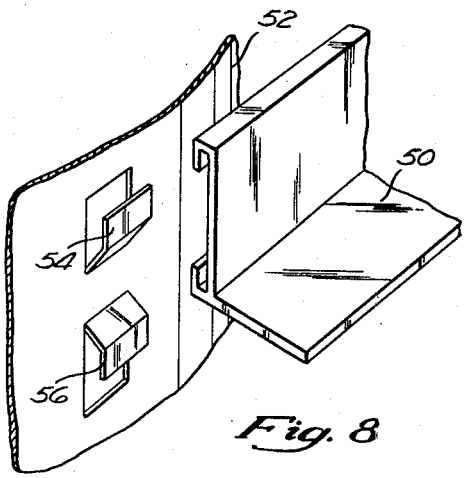
Fig. 8

Fig. 13
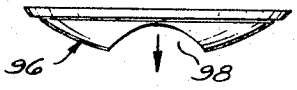
Fig. 14
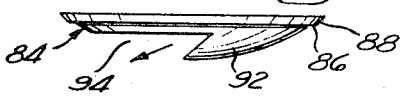
Fig. 13a
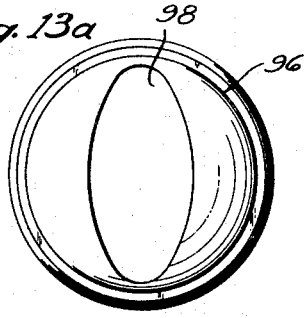
Fig. 14a
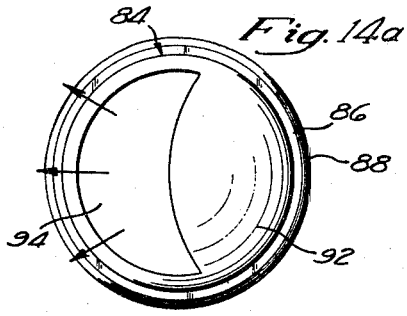
Fig. 15
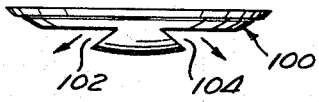
Fig. 16
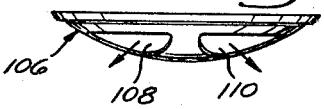
Fig. 15a
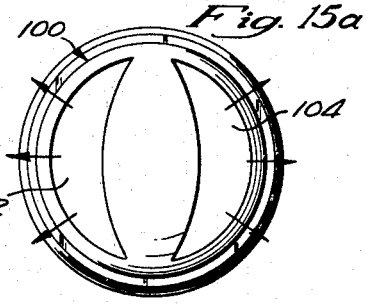
Fig. 16a
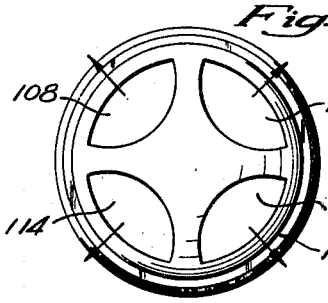
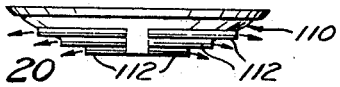
Fig. 20
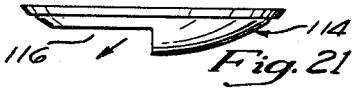
Fig. 21
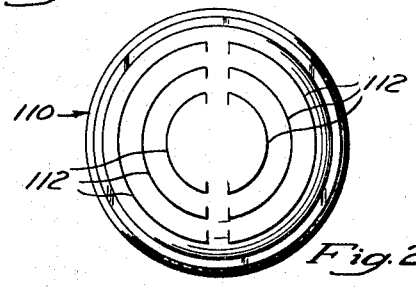
Fig. 21
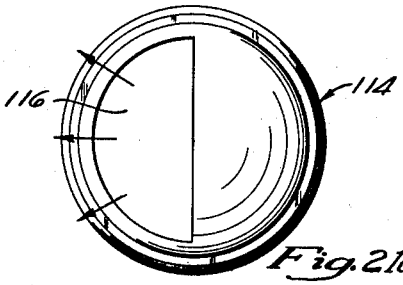
Fig. 21a

AIR DEVICE WITH FLEXIBLE MOUNTING SYSTEM

CROSS REFERENCE TO RELATED APPLICATION

This is a division, of application Ser. No. 06/095841, filed on Nov. 19, 1979, now U.S. Pat. No. 4,271,751, which is a division of David R. Timmons (my) copending Ser. No. 892,168, filed Mar. 31, 1978, entitled: Ventilation Air System and Terminal Device Therefor, now abandoned.

BACKGROUND

This invention is directed to a conditioned air system wherein air is delivered to a space wherein the air is conditioned and through the terminal device which delivers the air to the space and the diffuser which directs the air.

Forced ventilation systems are often used to supply ventilation air to a space. The ventilation air may be ambient outside air, or it may be treated air. Treatment may include heating, cooling, drying, humidifying, and/or filtering the air. The device which blows and treats the air delivers the air through ductwork. Ductwork is commonly cylindrical tubing which receives the air from the treatment equipment and constrains it on its passage toward the space where the air is to be delivered.

The prior art conventionally incorporates a transition structure which changes the cross section of the delivery structure from the cylindrical ducting to a rectangular or square ventilator outlet. This outlet is secured in the wall of the space to be ventilated. Such transition devices are expensive to build, because they transition from a circular tube to a rectangular cross section. Furthermore, such transition devices are usually mounted on the inside of the wall, ceiling or floor of the space to be ventilated so that the wall, ceiling or floor opening itself must be carefully located. As a consequence of this, the ductwork mounted upon the transition device also has its weight supported on the wall, ceiling or floor.

These various disadvantages are overcome by the ventilation air system and terminal device therefor of this invention.

SUMMARY

The present invention is embodied in and carried out by a terminal device for a ventilation air system, the terminal device serving as the transition from a circular air delivery duct through the wall, ceiling or floor of the space to be ventilated, and is also directed to the diffuser mounted to receive air from the terminal device and deliver it to the space to be ventilated. The terminal device has a circular section throughout and has means for mounting the terminal device on the structure which supports the wall of the space to be ventilated.

Thus, it is an object of this invention to provide a ventilation air system wherein the terminal device which transitions from the duct and delivers air to the space to be ventilated is circular in section. It is another object to provide a terminal device for a ventilation air system wherein the terminal device is mounted upon the structure which supports the wall, ceiling or floor of the space to be ventilated. It is a further object to provide a suitably adjustable support system for the terminal device so that the terminal device can be employed in a number of different positions. It is a further object to provide a diffuser for such a terminal device, wherein the diffuser is circular in configuration to cover the circular outlet of the terminal device. It is yet another object to provide a diffuser structure which may have different shapes of openings to be able to direct air from the terminal device in different directions at controlled velocities.

DESCRIPTION OF THE DRAWINGS

These and other features and advantages will become more apparent to those skilled in the art when taken into consideration with the accompanying drawings wherein like references indicate like or corresponding parts throughout the several views and wherein:

FIG. 5 is an isometric view of a second method of attaching the tubular transition member to its supporting bar, alternatively to the structure shown in FIG. 3.

FIG. 6 is a section showing the manner of installation of the embodiment of FIG. 5.

FIG. 7 is an isometric view of a third embodiment of the structure for attaching the transition device to its support bar.

FIG. 8 is similar to FIG. 7, but shows a fourth embodiment of the structure whereby the transition device is attached to its support member.

FIG. 9 shows the structure of FIG. 7 in transverse section and in assembled condition.

FIG. 13 is a side-elevational view of a diffuser having a single central opening for its straight-out discharge.

FIG. 13*a* is a plan view thereof.

FIG. 14 is a side-elevational view of the diffuser having a single side opening for directing air from a perimeter location.

FIG. 14*a* is a plan view thereof.

FIG. 15 is a side-elevational view of the diffuser having two openings for spreading air in opposite quadrants.

FIG. 15*a* is a plan view thereof.

FIG. 16 is a side-elevational view of a diffuser having four openings for spreading air in four quadrants.

FIG. 16*a* is a plan view thereof.

FIG. 20 is a side elevational view of a diffuser having a plurality of louvered opening.

FIG. 20*a* is a plan view thereof.

FIG. 21 is a side elevational view of a diffuser with a one half side opening; and FIG. 21*a* is a plan view thereof.

DESCRIPTION OF THE SHOWN EMBODIMENT

Figure 1:
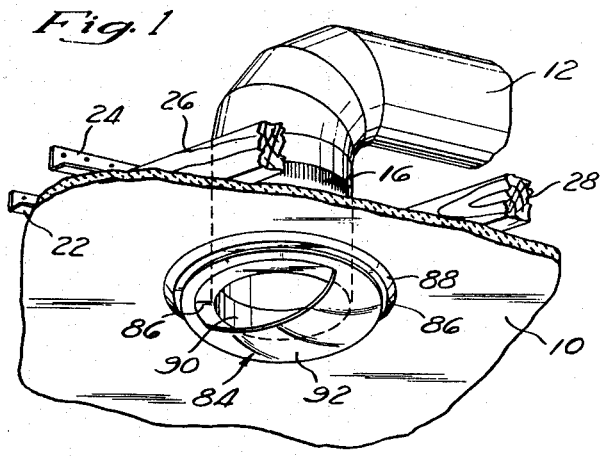
FIG. 1 is an isometric view of the preferred embodiment of the ventilation air system with its terminal device installed in a ceiling, as seen from the inside of the room space.
Figure 2:
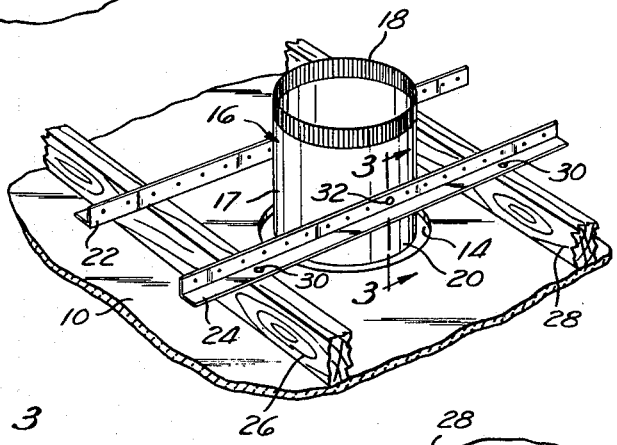
FIG. 2 is similar to FIG. 1, but is an isometric view taken from the exterior of the space showing the mounting structure in more detail.
Figure 3:
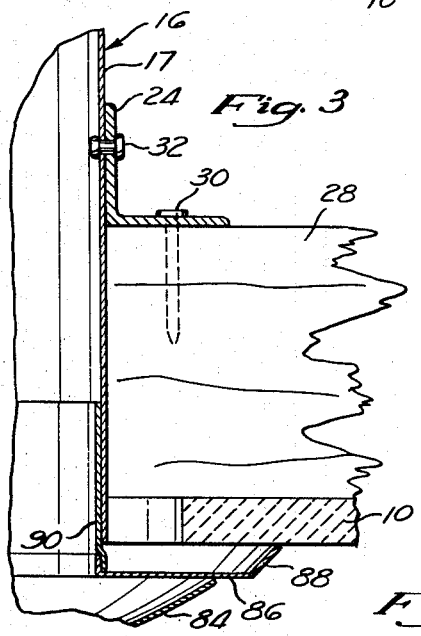
FIG. 3 is an enlarged section taken generally along the line 3—3 of FIG. 2.

As is seen in FIGS. 1, 2, 3 and 4, ceiling 10 serves as the top of an enclosed space and can be considered as one of the walls, ceiling or floor defining the space. The ventilation air system and the terminal device therefore in accordance with this invention are particularly suited for the delivery of ventilation air to rooms for human occupancy, although the ventilated spaces may be used for other purposes. An air treatment device treats the air to be delivered to the ventilated space and delivers it through duct 12 and other suitable ducts. Such ducts are normally circular in section, and it is the purpose of the ventilation air system and the terminal device to connect to ceiling 10 or the other walls of the enclosed space to permit the delivery of the treated air therethrough and directed in the desired direction. Opening 14, see FIGS. 2 and 3, is provided in the ceiling, and terminal device 16 is mounted therein.

As seen in FIGS. 1 through 4, terminal device 16 is a cylindrical tube which is adapted on its upper end 18 to engage with duct 12, and on its lower end 20 to extend into opening 14 and terminate flush with the room side of the ceiling layer. It also carries support devices thereon.

Figure 4:
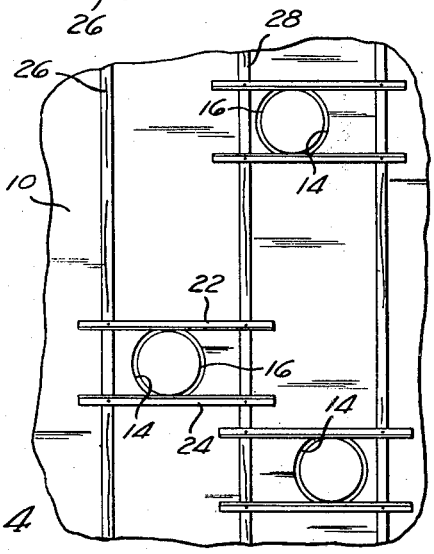
FIG. 4 is a top-plan view of a plurality of the terminal devices mounted on a ceiling, as seen from the outside of the enclosure.

In the preferred embodiment of FIGS. 1 through 4, the support devices are shown as a pair of metal, angular support bars 22 and 24 like angle irons which are secured both to the tubular body 17 and to the ceiling supporting structure. In this case, the ceiling supporting structure comprises ceiling joists 26 and 28. As is seen in FIG. 2, the support bars are nailed to the ceiling joists as by nail 30, or other conventional fastening means. Furthermore, the angular support bars are secured to tubular body 17 by means of rivets such as rivet 32, which is the preferable attachment, or by such alternative fastening means as sheet metal screws. As is seen in FIG. 4, the angular support bars are long enough to bridge across adjacent ceiling joists. Additionally, tubular body 17 is secured to the angular support bars at any position along their length, as is seen in FIG. 4, to permit the tubular body of the terminal air device to be positioned anywhere along the length thereof so as to permit it to enter the ventilated space close to or away from a ceiling joist, as is illustrated by the three positions shown in FIG. 4.

A plurality of holes are located in the upstanding flange of the angular support bars 22 and 24 to aid in securing the tube thereto. In this way, both lateral position and positioning of the lower end 20 flush with the ceiling surface is obtained, and then the securement is achieved. The combination of the tubular body with its angular support bars comprises the terminal device. A diffuser is employed in connection therewith.

FIGS. 5 and 6 show another method of securing the tubular body 34 to angular support bar 36. In this case, the securing means is tab 38 stamped from the side wall of tubular body 34, as is seen in FIG. 5. The tab 38 is positioned through one of the slots 40 of a series of slots on the upstanding flange of the angular support bar. As is seen in FIG. 6, after it is passed through, the tab can be bent down for the security of permanent attachment. As is seen in FIG. 5, several tabs may be stamped in the side wall of the tubular body so that selectivity of tab use can be achieved. Furthermore, the spacing of the tabs may be different from the spacing of the slots so that vernier attachment can be achieved as well as angular choice.

FIGS. 7 and 9 illustrate tubular body 42 of the air terminal device disclosed therein as carrying dovetail bracket 44. Dovetail bracket 44 is separately formed from tubular body 42 and is secured thereon by any convenient means, such as rivet 46. Angular support bar 48 is formed of folded sheet material, and it is formed with an upright flange which has a pair of longitudinal slots therein which cooperate with and receive the free ends of dovetail bracket 44. In this way, the terminal air device is formed by engaging the angular support bar on the dovetail bracket so that longitudinal adjustment of the tubular body along the length of the angular support bar is achieved.

In FIG. 9, angular support bar 50 is of the same functional configuration, but is of extruded material so that the dovetail-receiving slots are elongated slots which are formed integrally with the standing flange thereof.

The same angular support bar 50 is used in the terminal air device illustrated in FIG. 8. In that embodiment, tubular body 52 is provided with stamped-out tabs 54 and 56, which are integrally formed with the tubular body, but have free ends extending upward to form a dovetail structure which cooperates with the slots in angular support bar 50. It should be especially noted that in the structures of FIGS. 7, 8 and 9 the tubular body is movable along the length of the angular support bar for positioning between the supporting joints. In the structures of FIGS. 2, 5, 7 and 8, the angular support bars may have preformed holes through the horizontal web to aid in the securing of the angular support bars to the ceiling joints. In each of the structures of FIGS. 5 through 9, the terminal device is provided with two angular support bars, one on each side of the tubular body, in the same manner as in the embodiments of FIGS. 1 through 4.

Figure 12:
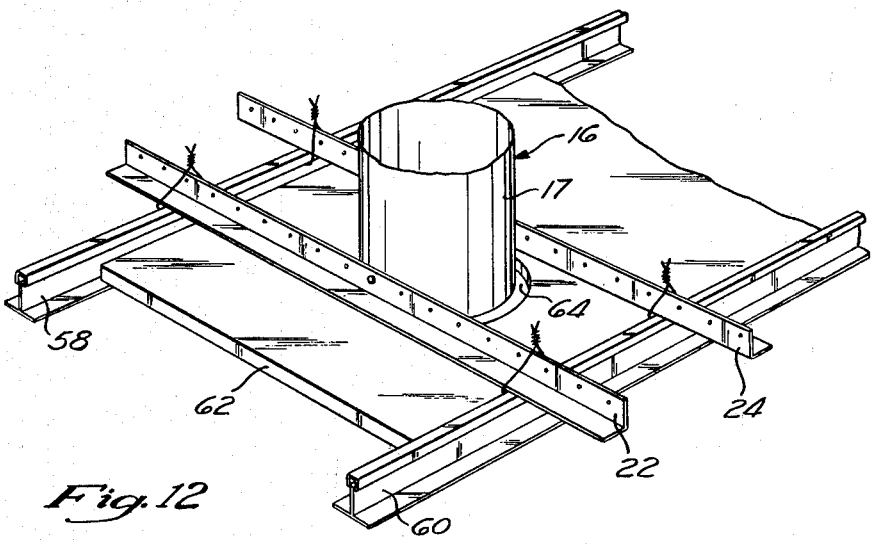
FIG. 12 is an isometric view of the first preferred embodiment of FIGS. 1 and 2, showing the terminal air device installed in a suspended ceiling.

FIG. 12 illustrates how the terminal air device 16 can be employed with a suspended ceiling construction. The suspended ceiling has T-bars 58 and 60 which are suspended by wires from an overhead structure. The ceiling panels 62 rest on the extended flanged heads of the T, as is conventional practice. The terminal air device 16 has its angular support bars 22 and 24 extending across the T-bars. The angular support bars are wired down through the T-bars for firm securement. Tubular body 17 of the terminal device enters into an appropriate opening 64 in the ceiling panel so that treated air is discharged through into the space below the ceiling.

Figure 10:
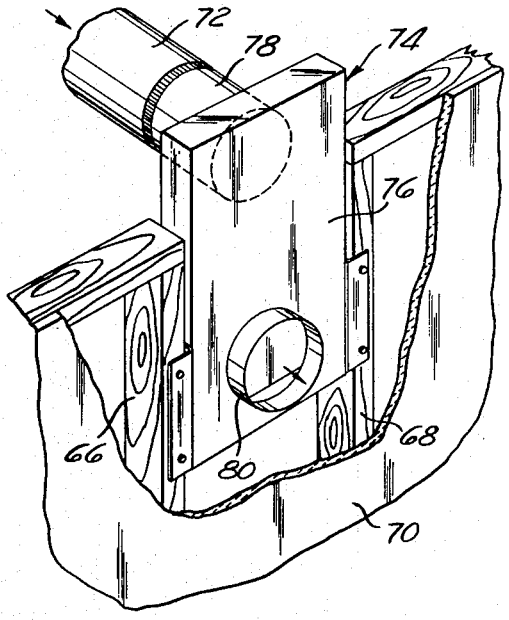
FIG. 10 is an isometric view of a different type of terminal device, where the terminal device is especially adapted to fit into a studded wall.
Figure 11:
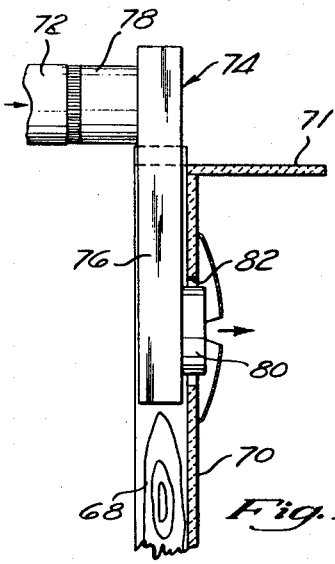
FIG. 11 is a vertical section taken through a portion of the structure of FIG. 10 showing it in the assembled condition.

FIGS. 10 and 11 illustrate another terminal device for bringing treated air into a room through the side walls thereof when the duct work is above the room space. Such an arrangement is often occassioned by residential construction. Studs 66 and 68 support wall finish material 70, while ceiling joists, such as shown in FIG. 2, support the ceiling 70. Duct 72 delivers treated air for delivery into the room, but is positioned in the attic above the ceiling. Terminal air device 74 is especially arranged to provide the delivery of the treated air into the room under those circumstances. Terminal air device 74 comprises box 76, conventionally formed of sheet metal, which fits between the studs, is nailable thereto, and extends above the ceiling. Collar 78 interconnects duct 72 with box 76. Box 76 also carries tubular body 80 which extends through opening 82 in wall 70 to discharge treated air into the room.

Figure 19:
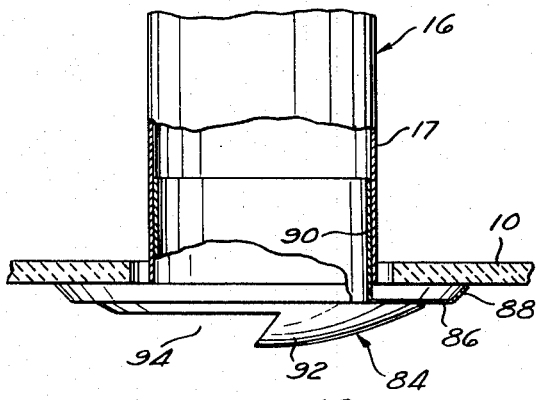
FIG. 19 is a transverse section through the preferred embodiment of the terminal air device showing it equipped with a diffuser having a collar thereon for reducing air flow velocity.

Diffuser 84, seen in FIGS. 1, 14, 14*a* and 19, is seen in largest detail in FIG. 19. Diffuser 84 is the preferred embodiment. It comprises escutcheon plate 86 which has rim 88 therearound which holds the escutcheon plate away from ceiling 10. Collar 90 is secured to escutcheon plate 86, and the plate is opened interiorly of the collar so that air passing through collar 90 passes to the front of the escutcheon plate. Collar 90 is dimensioned to interengage with the tubular body 17 of terminal air device 16 and to the other terminal devices described above. Collar 90 preferably enters the interior of body 17. The rim 88 on the escutcheon plate provides a recess behind the escutcheon plate so that the rim fits firmly against the ceiling even when the lower end of the terminal air device might protrude slightly below the ceiling level. Furthermore, collar 90 extends sufficiently far into the terminal air device so that, if the lower end of the terminal air device does not quite reach the lower face of the ceiling, adequate interengagement is assured.

Figure 19A:
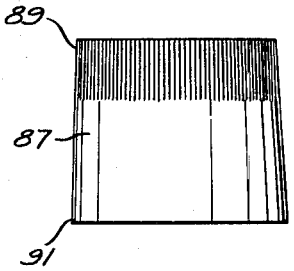
FIG. 19*a* is a side elevation of a reducer which is used to reduce air velocities.

FIG. 19*a* shows an optional device which is used to reduce air velocity from within the air ducts. The reducer 87 is also cylindrical to be consistant with the ducting and has one end 89 which has the same diameter as the ducting. The opposite end 91 is enlarged to match the size of the diffuser 84 thus leaving the reducer 89 in a tapered configuration.

Dome 92 is secured to the front of escutcheon plate 86 and extends beyond the opening therethrough laterally of collar 90. Dome 92 serves as a decorative cover and as a director of the treated air. In the case of diffuser 84, opening 94 in the dome directs air in a half circle substantially parallel to the ceiling, as illustrated by the arrows in FIGS. 14 and 14*a*. Different types of openings direct the air in different directions. The shape of dome 92 has a basic advantage of reducing the friction of the airflow as the area of the dome 92 is increased and airpressure thereagainst has less friction due to increased area.

Diffuser 96, seen in FIGS. 13 and 13*a*, is the same as diffuser 84, except that it has an opening 98 of oval configuration positioned toward the center of the dome so as to direct air straight ahead from the diffuser which is centrally outward in the usual ceiling or wall installation.

Diffuser 100 of FIGS. 15 and 15*a* is the same as diffuser 84 except that it has openings 102 and 104 in the dome. These openings are configured to direct the air generally in two opposite half circles, closely adjacent the ceiling.

Similarly, diffuser 106 (seen in FIGS. 16 and 16*a*) is the same as diffuser 84 except that it is provided with openings 108, 110, 112 and 114. These openings are positioned to direct air out of the diffuser in four quadrants. It provides more uniform air distribution under the ceiling than is provided by diffuser 100.

Figure 17:
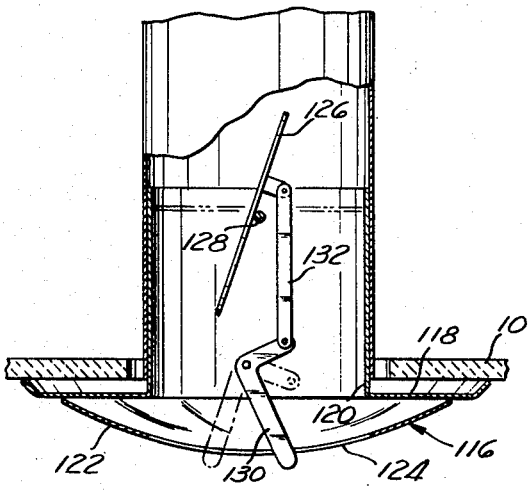
FIG. 17 is a transverse section through the preferred embodiment of the terminal device, showing it equipped with a damper or volume control device.
Figure 18:
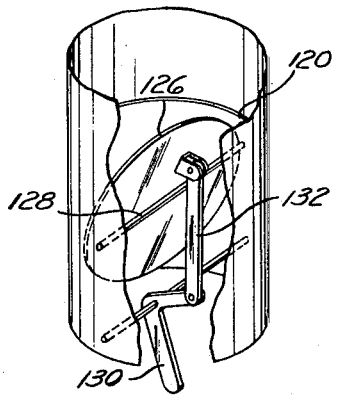
FIG. 18 is an isometric view thereof.

Diffuser 116, shown in FIGS. 17 and 18, is similar to diffuser 84 seen in FIG. 19. Diffuser 116 has escutcheon plate 118 with a rim and with collar 120. Dome 122 is secured over the face of the escutcheon plate to form an air chamber therebeneath and has opening 124 therein. What is different about diffuser 116 is the presence of damper 126 therein. Damper 126 is a substantially circular disc mounted on crosspin 128 so that the damper is rotatable from a position where the collar 120 is substantially open and unobstructed to the flow of air therethrough to a position where the collar is substantially closed to almost fully obstruct the flow of air therethrough. Damper 126 is controlled by bell crank operator 130, which is positioned to be reachable through opening 124. Link 132 interconnects the operator and damper 126. In that way, the occupant of the room can move operator 130 to adjust damper 126 to control the flow of air into the room through the diffuser. If desired, the operator structure could be arranged so that it can only be moved by key operation so that maintenance personnel can adjust the damper position without the ability of the room accupant to make such an adjustment. Thus, diffuser 116 is the same as diffuser 84 with the addition of an operator control damper.

Referring collectively to FIGS. 20 and 20*a*, there is shown a further example of a diffuser 110 which has a plurality of louvers 112 which are pressed into the diffuser which can easily be stamped into the diffusers dished dome. The louvers 112 allow the air to be disbursed in all directions.

FIGS. 21 and 21*a* illustrate a further diffuser 114 which includes a fifty percent opening 116 to direct the conditioned air in a desired direction.

A unique principle of dishing or doming the diffusers provides less air friction because the area in which the air blows against is enlarged and thereby reduces the friction thereon. Thus the principal is to achieve a higher free area ratio of duct free area versus available discharge free area on the face of the diffuser's dished area. On the fifty percent dished opening 116 there is an increase of the face ratio versus the duct area by adding fifty percent additional cubic feet per minute output.

Any one of the diffusers can be positioned in any one of the terminal devices so that air can be distributed in accordance with the requirements of the space to which the air is delivered. The employment of a circular terminal air device permits functionally direct interconnection from the duct to the diffuser, which only serves to direct the air into the room without requiring transition into another shape of air flow.

This invention having been described in its preferred embodiment, it is clear that it is susceptible to numerous modifications within the ability of those skilled in the art and without the excerise of the inventive faculty. Accordingly, the scope of this invention is defined by the scope of the following claims:

I claim:

1. An air terminal device for connection to the end of an air duct, comprising:

(a) a rigid conduit having an inlet end and an outlet end, said inlet end being adapted for connection to an air duct and said outlet end being adapted for connection to an air discharge device;

(b) first and second opposed support members each comprising a first portion disposed parallel to the longitudinal axis of said rigid conduit for selective non-slidable attachment to said rigid conduit at any one of a plurality of discrete positions between said opposed support members, and a second portion disposed at an angle with respect to said first portion to enable connection of said opposed support members to two spaced building structural members and thereby to provide support in space for said rigid conduit at substantially any selected location between two spaced building structural members;

(c) first and second opposed attachment means operative to enable said selective non-slidable attachment of said first and second opposed support members, respectively, to said rigid conduit; and (d) wherein said first and second opposed attachment means each comprises a tab stamped from said rigid conduit and at least one slot in the first portion of the associated support member for receiving said tab.

2. The air terminal device according to claim 1, wherein said first portion of said first and second opposed support members each comprises a plurality of slots for selectively receiving the associated tab.

3. The air terminal device according to claim 1, wherein said inlet and outlet ends of said rigid conduit are of identical cross-sectional shape.

4. The air terminal device according to claim 3, wherein said inlet and outlet ends of said rigid conduit are of identical cross-sectional size.

* * * * *